US007182279B2

(12) United States Patent
Wang

(10) Patent No.: US 7,182,279 B2
(45) Date of Patent: Feb. 27, 2007

(54) ATOMIZER FOR ATOMIZING MOLTEN METAL

(75) Inventor: Chuih-Kuan Wang, Tainan (TW)

(73) Assignee: National Cheng Kung University, Tainan (TW)

( * ) Notice: Subject to any disclaimer, the term of this patent is extended or adjusted under 35 U.S.C. 154(b) by 177 days.

(21) Appl. No.: 10/974,882

(22) Filed: Oct. 28, 2004

(65) Prior Publication Data

US 2006/0097074 A1 May 11, 2006

(51) Int. Cl.
*B05B 1/26* (2006.01)
*B22F 9/00* (2006.01)

(52) U.S. Cl. ..... 239/522; 239/518; 239/396; 239/589; 239/390; 239/398; 75/337; 75/339

(58) Field of Classification Search ..... 239/396, 239/589, 390, 8, 270, 391, 398, 406, 411, 239/426, 461, 483, 499, 504, 590.3; 75/337–339
See application file for complete search history.

(56) References Cited

U.S. PATENT DOCUMENTS 442,762 A * 12/1890 Wainwright ..... 239/396
4,134,547 A * 1/1979 Gamst ..... 239/404
4,426,213 A * 1/1984 Stavropoulos ..... 55/466
4,455,166 A * 6/1984 Brancaz et al. ..... 75/553
5,170,946 A * 12/1992 Rankin ..... 239/590
5,862,996 A * 1/1999 Crichton ..... 239/583
6,098,904 A * 8/2000 Davidson et al. ..... 239/590
2004/0060996 A1* 4/2004 Jansohn et al. ..... 239/8
2005/0017094 A1* 1/2005 Wang ..... 239/522

* cited by examiner

*Primary Examiner*—Kevin Shaver
*Assistant Examiner*—James S. Hogan
(74) *Attorney, Agent, or Firm*—Rosenberg, Klein & Lee

(57) ABSTRACT

An atomizer includes a T-shaped chamber with tapered insides and an outlet which is in communication with the chamber. A first path is located in a center area in the chamber so as to introduce molten metal therein and two second paths are introduced into the chamber so as to send inert gas into the chamber. A separator is located in the chamber and located at an outlet end of the first path. A narrow passage is defined between an inside of the outlet and the separator. The impact of the inert gas and the molten metal atomizes the metal.

3 Claims, 5 Drawing Sheets

ATOMIZER FOR ATOMIZING MOLTEN METAL

FIELD OF THE INVENTION

The present invention relates to an atomizer for atomizing molten metal by impact with high speed inert gas.

BACKGROUND OF THE INVENTION

Atomizers are used in a wide variety of fields from showerheads, furnaces, energy industries, turbine systems, powder metallurgy to jet engines. It is important to obtain the atomized particles as small as possible so as to meet the requirements of the use.

The present invention intends to provide an atomizer that includes a chamber and a separator is located in the chamber so as to define narrow paths through which the molten metal is injected. Inert gas is injected to hit the molten metal so as to obtain atomized particles.

SUMMARY OF THE INVENTION

The present invention relates to an atomizer which comprises a T-shaped chamber with tapered insides and an outlet which is in communication with the chamber. A first path for introducing the molten metal into the chamber is located in a center area in the chamber and a second path for introducing inert gas into the chamber. A separator is located in the chamber and at an outlet end of the first path. A narrow passage is defined between an inside of the outlet and the separator. The molten metal is hit by the inert gas and atomized by the waves of the molten metal and the inert gas.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
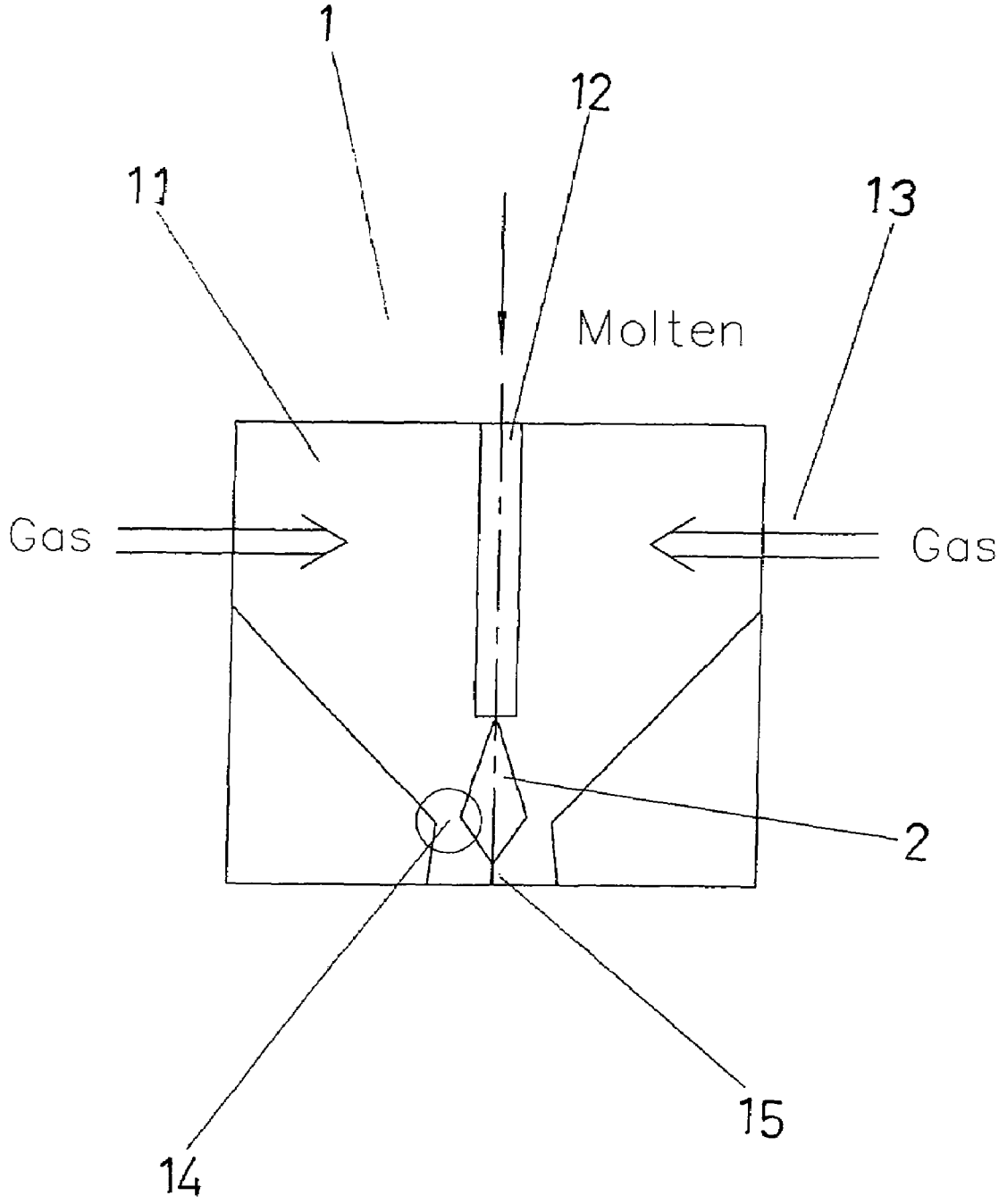
FIG. 1 shows a first embodiment of the atomizer of the present invention.

Referring to FIG. 1, the atomizer 1 of the present invention comprises a T-shaped chamber 11 with tapered insides and an outlet 15 which is in communication with the chamber 11 and is sized narrower than the chamber 11. A first path 12 is located in a center area in the chamber 11 and two second paths 13 are introduced into the chamber 11. A separator 2 is located in the chamber 11 and at an outlet end of the first path 12. At least one narrow passage 14 is defined between an inside of the outlet 15 and the separator 2. The narrow passage 14 communicates with a portion of the outlet 15 and the portion is wider than the narrow passage 14. In other words, there is at least one wide-narrow-wide path formed in the atomizer 1.

The molten metal is provided into the chamber 11 via the first path 12 and the stream of the metal is split by the separator 2 which can be a diamond-shaped block. Inert gas is injected into the chamber 11 via the two second paths 13 and hits the molten metal. The waves of the stream of the molten metal and the inert gas accelerate the atomizing process of the molten metal.

Figure 2:
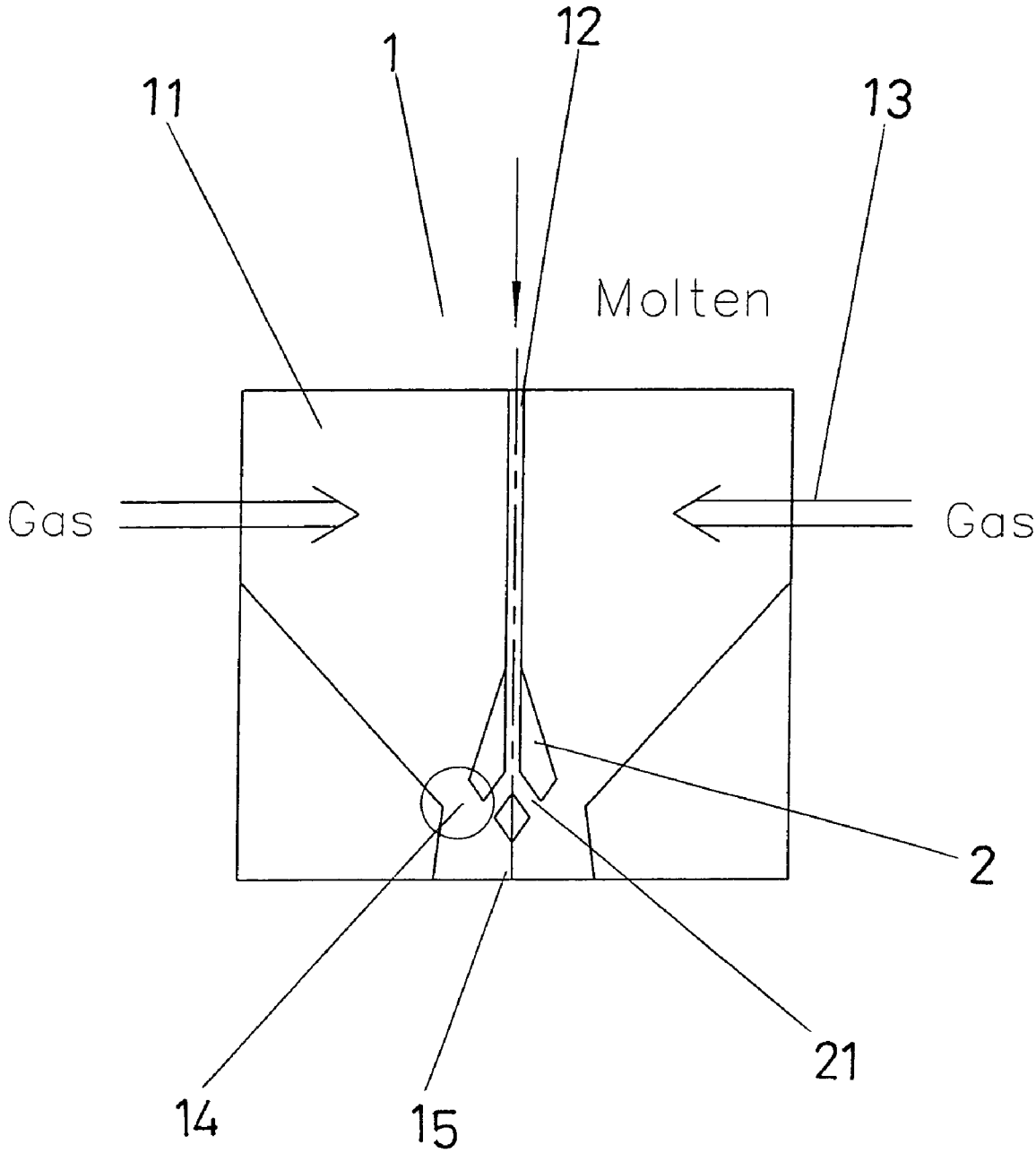
FIG. 2 shows a second embodiment of the atomizer of the present invention.
Figure 3:
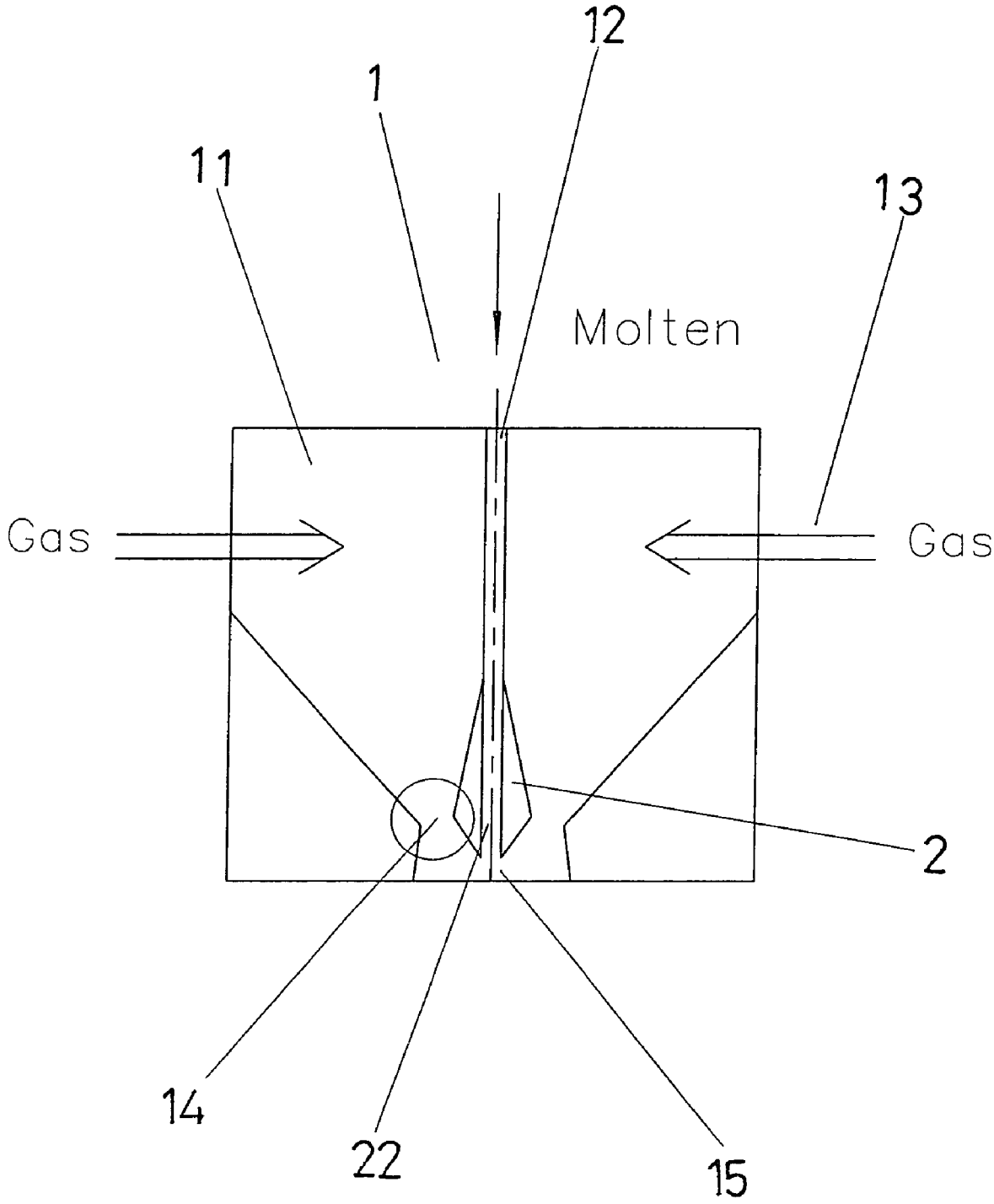
FIG. 3 shows a third embodiment of the atomizer of the present invention.

FIG. 2 shows that the separator 2 includes three separated diamond-shaped portions so as to define sub-passages 21 therebetween and this arrangement changes the directions and the speed of the molten metal. In FIG. 3, the separator 2 includes two diamond-shaped portions and the molten metal passes through a gap between the two diamond-shaped portions.

Figure 4:
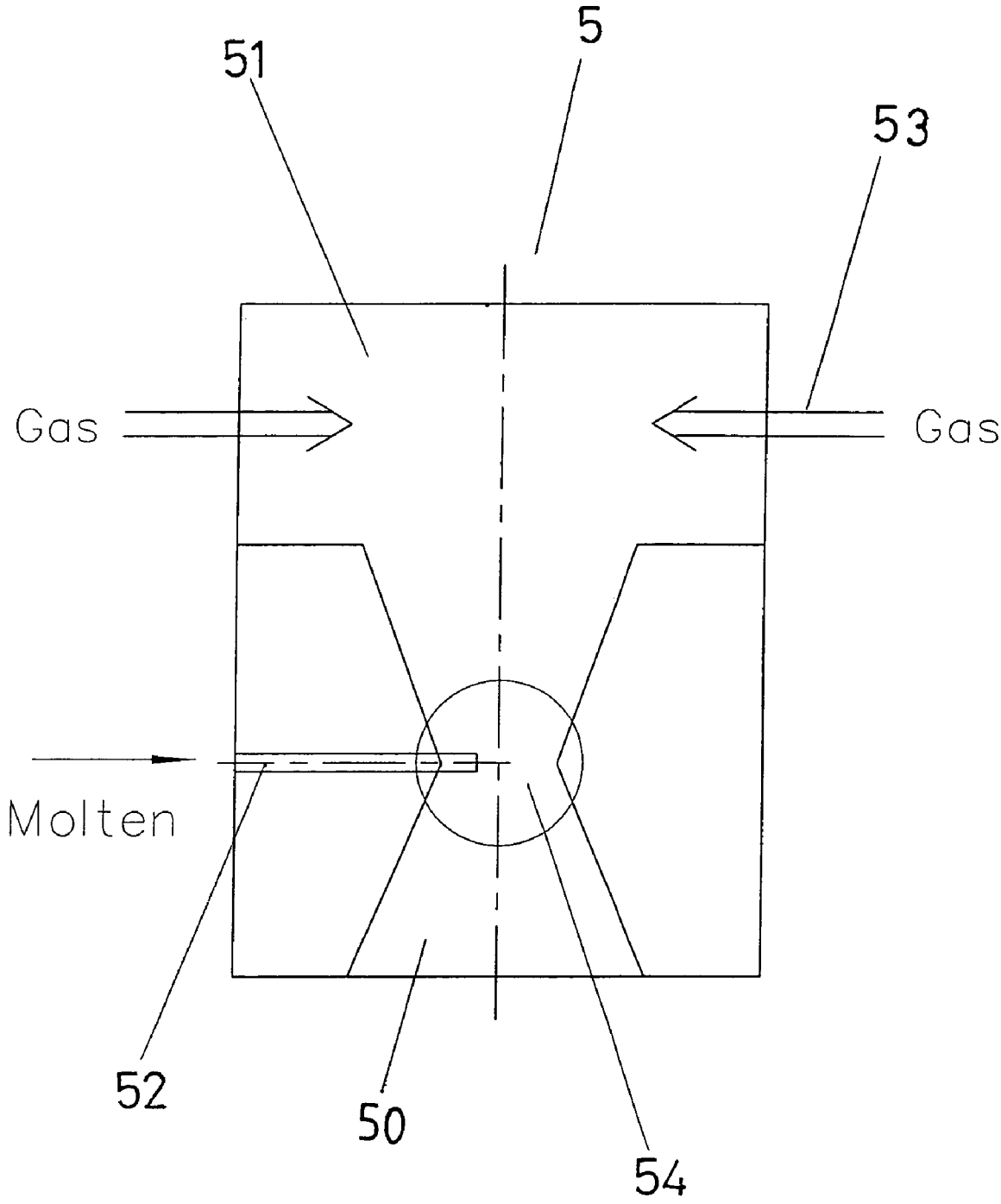
FIG. 4 shows a fourth embodiment of the atomizer of the present invention.

FIG. 4 shows another type of atomizer 5 which comprises a T-shaped chamber 51 with tapered insides and an outlet 50 which is in communication with the chamber 51. The outlet 50 includes a narrow section 54. A first path 52 for providing molten metal transversely penetrates through a wall of the atomizer 5 and communicates with the narrow section 54 of the outlet 50. Two second paths 53 are introduced into the chamber 11.

Figure 5:
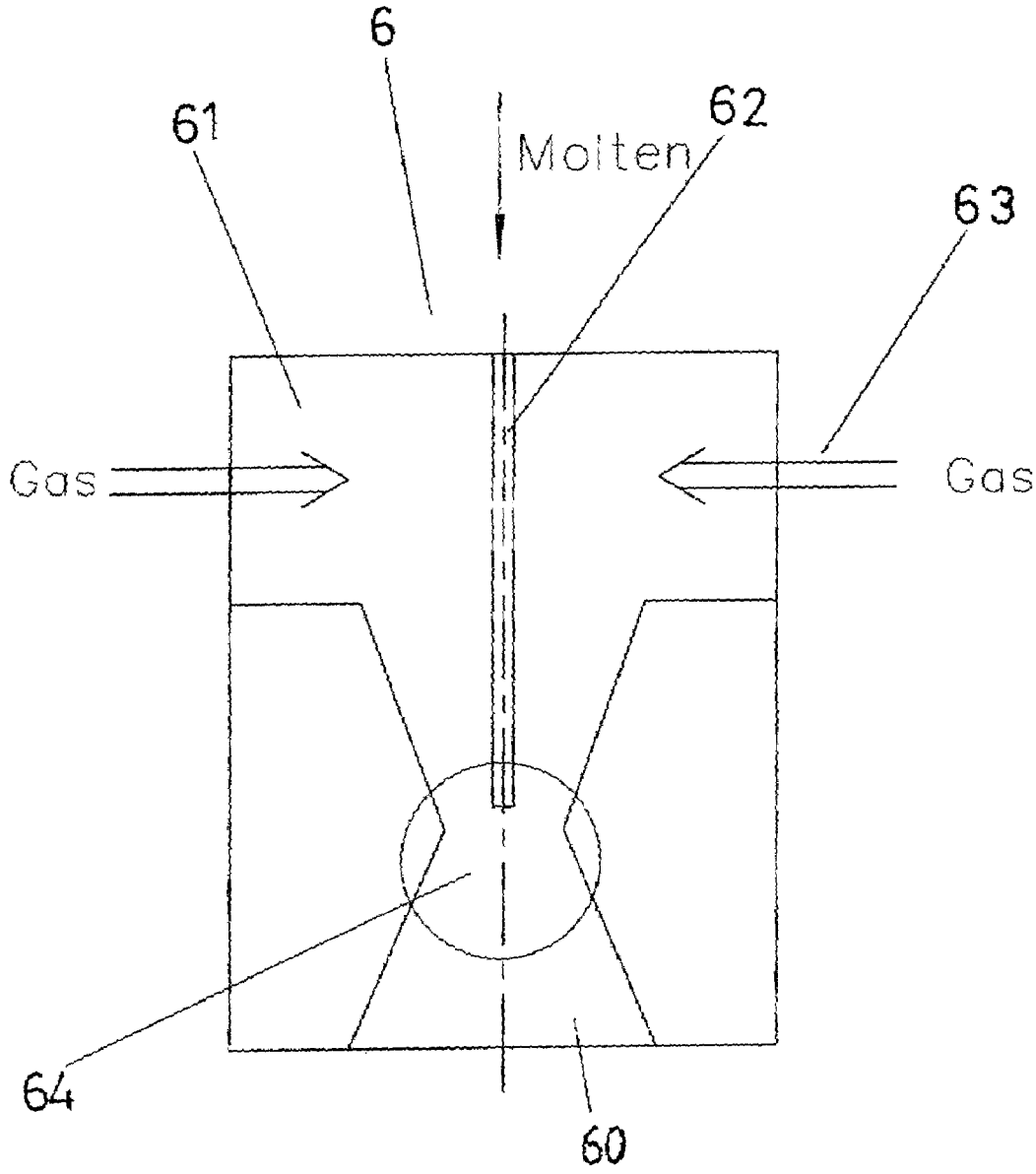
FIG. 5 shows a fifth embodiment of the atomizer of the present invention.

FIG. 5 shows another atomizer 6 which comprises a T-shaped chamber 61 with tapered insides and an outlet 60 which is in communication with the chamber 61. The outlet 60 includes a narrow section 64. A first path 62 is located in a center of the chamber 61 and a second path 13 is introduced into the chamber 11. An outlet of the first path 62 is located in the narrow section 64.

While we have shown and described the embodiment in accordance with the present invention, it should be clear to those skilled in the art that further embodiments may be made without departing from the scope of the present invention.

What is claimed is:

1. An atomizer comprising:

a T-shaped chamber with tapered insides and an outlet which is in communication with the chamber;

a first path located in a center area in the chamber and a second path being introduced into the chamber, and a separator located in the chamber and located at an outlet end of the first path, a narrow passage defined between an inside of the outlet and the separator, the separator including three separated diamond-shaped portions so as to define sub-passages therebetween.

2. The atomizer as claimed in claim 1, wherein the narrow passage communicates with a portion of the outlet and the portion is wider than the narrow passage.

3. The atomizer as claimed in claim 1, wherein the separator is a diamond-shaped block.

* * * * *